United States Patent [19]

Hanscom

[11] Patent Number: 4,705,080

[45] Date of Patent: Nov. 10, 1987

[54] BUNDLE TYING MACHINE

[75] Inventor: John F. Hanscom, Rehoboth, Mass.

[73] Assignee: H.F. Hanscom & Company, Inc., Providence, R.I.

[21] Appl. No.: 899,554

[22] Filed: Aug. 25, 1986

[51] Int. Cl.[4] ..... B21F 7/00

[52] U.S. Cl. ..... 140/93 A; 140/115

[58] Field of Search ..... 140/57, 93 A, 115, 118, 140/119, 120

[56] References Cited

U.S. PATENT DOCUMENTS 1,074,587 9/1913 Curry ..... 140/93 A 2,770,183 11/1956 Hanscom .

3,384,006 5/1968 Helligrath et al. .

3,490,128 1/1970 Cammilli et al. .

3,880,204 4/1975 Sarff et al. ..... 140/93

4,270,804 6/1981 Boulachanis ..... 140/115

*Primary Examiner*—Lowell A. Larson

*Attorney, Agent, or Firm*—Barlow & Barlow, Ltd.

[57] ABSTRACT

A bundle typing device is provided with a pair of jaws which are mounted so that the jaw ends move toward and away from each other and are adapted to receive tie stock thereacross. The jaw ends with the tie stock are drawn over a bundle, the tie stock embracing the bundle. The jaws are then rotated to twist the tie stock about the bundle.

2 Claims, 6 Drawing Figures

BUNDLE TYING MACHINE

BACKGROUND OF THE INVENTION

This invention relates to the field of bundling a plurality of wires or other articles and more particularly to a tool or device which is power operated and which is portable for applying a tie about a bundle of wires or the like. Tools for applying ties about wires and harnesses either take the form as seen in the Hidassy Pat. No. 4,371,010 (Cl. 140/93.2), or are of the type where tape is wrapped about wires as seen in the Mercer et al Pat. No. 4,265,687 (Cl. 100/33PB). In each of the aforementioned forms a tie is permanently secured about a bundle. It is desirable in many instances that the tying device place a strap around the bundle of wires which can be readily removed. This is particularly desirable in wiring harnesses for installation in a fixed structure. Up to now it has been customary to hand tie bundles of wire which is time consuming.

It is therefore an object of this invention to provide a tying device performing a temporary tie about a bundle by a mechanically, automatic, light, relatively uncomplicated mechanism.

SUMMARY OF THE INVENTION

The apparatus for tying a bundle includes a pair of arms that have gripping jaws to grip a piece of tie stock, the arms being mounted in such a way that they may move toward and away from each other. Tie stock drawn from a supply spool is suitably led in a metered fashion so as to pass between the ends of the jaws and be gripped therein. In addition, a severing device is placed in the path of the tie stock to cut the tie stock after a predetermined amount has been delivered across the jaw ends. The jaws move as a unit with the tie stock between the ends thereof and embrace the bundle. After the bundle has been embraced, the tie stock is tightened thereabout by the ends of the jaws moving together, and once the jaws are together, rotational movement is imparted to the arms so that the tie stock is twisted and is further tightened about the bundle. Preferably to achieve the above action the arms are mounted on the end of a shaft and are pivoted intermediate the ends thereof to an end block affixed to the shaft. The shaft also has a cam device affixed thereto so that the inner end of the arms rise on the cam device that imparts the closing motion to the gripping jaw end of the arms. As the jaws and the shaft move laterally, there is a drive means that is engaged by the shaft which then rotates the shaft a predetermined amount to cause the twisting of the tie stock.

It will be appreciated from the foregoing that the invention provides a portable apparatus for wrapping tie stock about a bundle of items or wires that ends up with a twisted tie about the bundle that can be considered permanent or semi-permanent as the case might be.

DESCRIPTION OF THE PREFERRED EMBODIMENT

Figure 1:
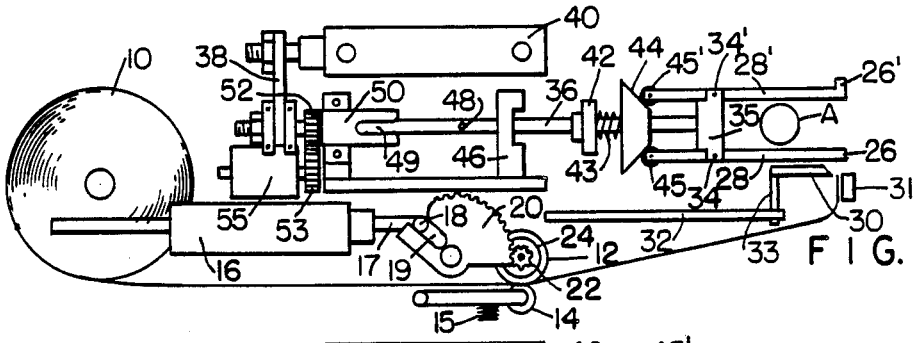
FIGS. 1–6 are schematic diagrams of a preferred embodiment of a bundle tying device made in accordance with the invention that illustrate in various stages the sequence of operations of the device.

In its preferred form the bundle tying device should be mounted on a framework that resembles a large pistol with the body of the device as illustrated in the drawings being in that portion that would be equivalent to the barrel of the pistol, whereas a handle and grip-like portion (not illustrated) would form the grip and provide an actuating means which will start the cycle of operation.

Figure 2:
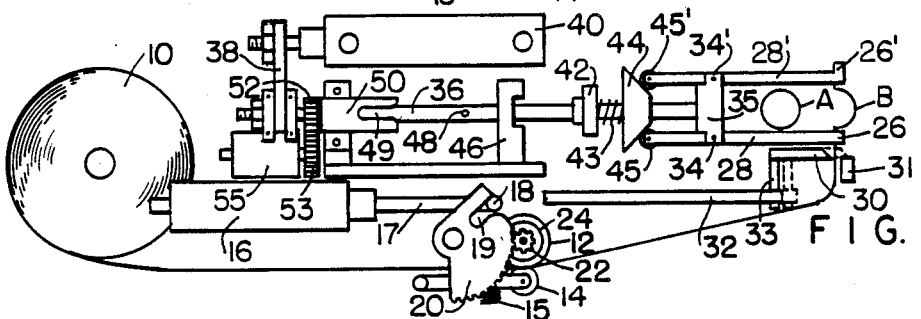

FIG. 1 of the drawings illustrates essentially an at-rest position, that is to say, this is the position that the parts will always return to once a complete wrapping and twisting cycle has taken place. In the figures therefore, there is illustrated a supply of tie stock designated 10 which may be led in a suitable fashion from its location to a metering wheel 12, the tie stock being pressed against the metering wheel by an idler 14 through urgence of spring 15. For feeding tie stock, a longitudinal actuator in the form of an air cylinder 16 is provided; and at the end of its actuating shaft 17 is a roller 18 that engages in a cam path 19 of a sector gear 20. As will be appreciated by viewing the drawing, the sector gear 20 engages a spur gear 22 on the feed wheel 12. Essentially, therefore, a forward stroke of the air cylinder rod 17 rotates the feed wheel via a one-way clutch 24, and since the pressure roll 14 maintains the tie stock against the feed wheel, a pre-set length of tie stock will be fed to gripping jaws 26, 26' of a pair of arms 28, 28'. The length of tie stock can be controlled by limiting the stroke or rod 17. As seen particularly in FIG. 2, the tie stock promotes a bowing of the tie material as at B, and as further seen in FIG. 2, the continued movement of the shaft 17 in a forward direction will engage a cut-off knife 30 which acts against an anvil 31 and which is moved into the dotted line position by virtue of a mechanical coupling indicated by the bar 32 and coupler 33. Having now traveled its full stroke, the rod 17 of the air cylinder 16 will return to its initial position as seen in FIG. 1 and also in FIGS. 3–6. While the return is being effected, the engagement of the sector gear with the gear 22 will effect no motion of the feed wheel 12 as the one way clutch 24 will impart no motion thereto.

Figure 3:
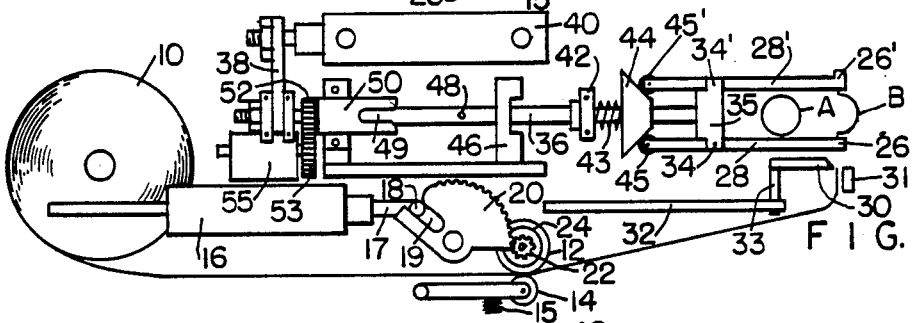

Referring now to FIG. 3 of the drawings, the bundle to be tied is represented by the letter A, and it will be noted that the arms 28, 28' embrace this bundle. The arms are pivoted as at 34, 34' on a block 35 that is attached to the end of a shaft 36, which at its other end is coupled by means of a coupling plate 38 to an air cylinder or retractor 40. Intermediate on the shaft is a thrust bearing 42 and spaced from the thrust bearing 42 by a compression spring 43 is an incline plane 44 that rides on the shaft 36 and engages rollers 45, 45' mounted on the ends of arms 28, 28'. For guidance of the shaft a support 46 is illustrated, the support also serving as a stop abutment.

Figure 4:
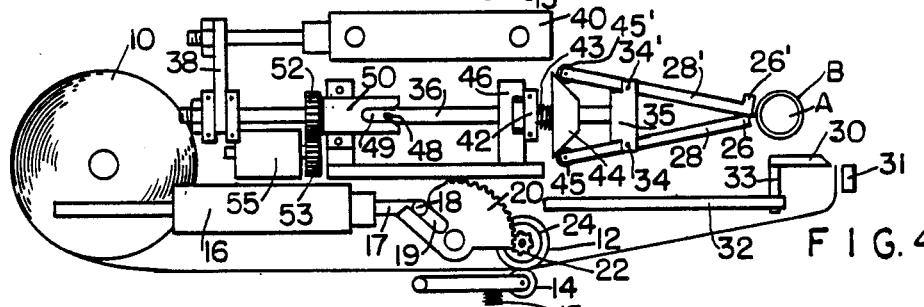
Figure 5:
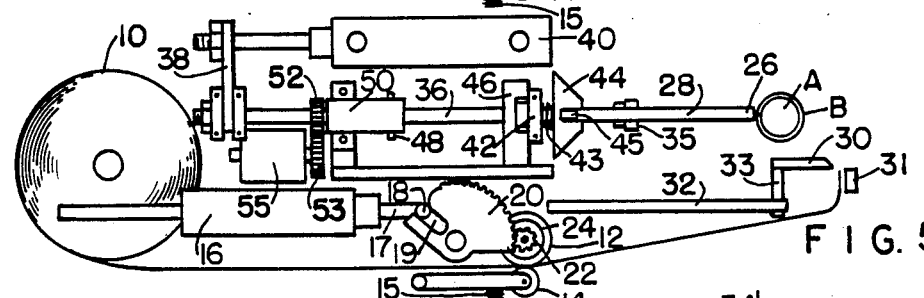
Figure 6:
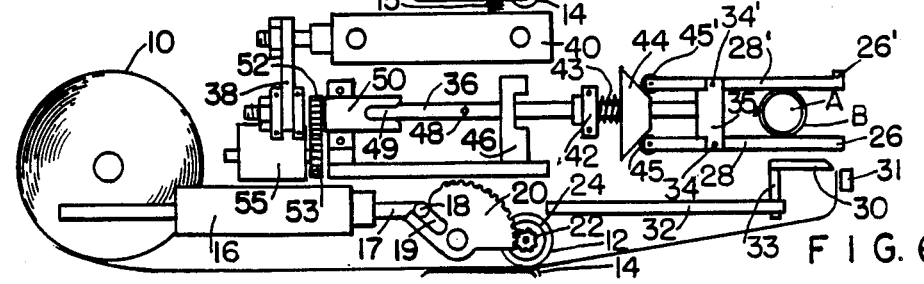

Referring to FIG. 4, actuation of the air cylinder 40 will pull the shaft 36, and in turn the arms 28,28' to the left as seen in the drawing; and as this occurs, the thrust bearing 42 will engage the support 46. Further movement of the shaft 36 to the left causes the arms to be drawn further to the left and the inner ends thereof with their rollers 45, 45' will roll up the inclined plane 44. As this occurs, a pin 48 that is termed a qualification pin, will enter a slot 49 of a sleeve 50. The sleeve 50 is coupled via a gear drive 52, 53 to a rotary actuator 55. It will also be observed that the tie stock has now been wrapped about the bundle. Since the apparatus is now ready for the twist portion of the cycle, the position of the shaft 36 through a switch (not shown), initiates the rotary actuator 55 that in turn will rotate the shaft 36 and twist the tie stock about the bundle, as seen further in FIG. 5 of the drawings. When the twisting has been completed and the tie stock has slipped out of the gripping jaws on the ends of the arms 28, 28', the air cylinder 40 will be depressurized and allow the shaft 36 to move to the right as seen in the drawings with the arms open and ready for the next feed cycle. As this occurs, the forward motion of the shaft permits the pin 48 to disengage from the drive sleeve 50; and when the shaft has reached its most forward or position most to the right as viewed in the drawings, the rotary actuator 55 and its gear drive will be reverse rotated the same number of revolutions as it turned in the twist cycle so that it will be ready for the next complete cycle. It will be noted that this will not rotate the arms as the pin 48 is no longer held in the sleeve 50.

I claim:

1. A bundle tying device for wrapping a tie about a bundle and twisting the tie comprising:

(a) a pair of longitudinally movable arms having gripping jaws at one end thereof, (b) a shaft, the arms being pivoted intermediate the ends thereof to the shaft, said arms being normally oriented in a datum position, (c) means engaging the end of the arms remote from the gripping jaws to impart movement of the jaw ends toward each other, seperate means urging the jaw ends apart, (d) means feeding tie stock across the arms into the jaws, (e) means for severing the tie stock, (f) retractor means coupled to the shaft for longitudinal movement thereof drawing the jaw ends with tie stock therein over the bundle into tying position whereby the tie stock partially embraces the bundle, (g) means imparting closing movement of the jaw ends, (h) a sleeve having a slot embracing the shaft, (g) means imparting closing movement of the jaw ends, (h) a sleeve having a slot embracing the shaft, (i) means including a rotary actuator coupled to said sleeve, a drive pin on said shaft, said pin engaging said slot in said sleeve whereby rotational movement to the arms is imparted only while in closed position to twist the tie in one direction and tighten it about the bundle, (j) said retractor means moving the arms from tying position to datum position and disengaging the drive pin and sleeve slot engagement.

2. A bundle tying device for wrapping a tie about a bundle and twisting the tie comprising:

(a) a pair of longitudinally movable arms having gripping jaws at one end thereof, (b) a shaft, the arms being pivoted intermediate the ends thereof to the shaft, (c) means engaging the end of the arms remote from the gripping jaws to impart movement of the jaw ends toward each other, seperate means urging the jaw ends apart, (d) means feeding tie stock across the arms into the jaws, including a metering gear segment coupled to a feed wheel via a one-way clutch and a longitudinal actuator engaging a slot in the gear segment, actuation thereof rotating the gear segment, (e) means for severing the tie stock, (f) means drawing the jaw ends with tie stock therein over the bundle whereby the tie stock partially embraces the bundle, (g) means imparting closing movement of the jaw ends and, (h) means imparting rotational movement to the arms while in closed position to twist the tie and tighten it about the bundle.

* * * * *